US007201566B2

(12) United States Patent
Cäsar et al.

(10) Patent No.: US 7,201,566 B2
(45) Date of Patent: Apr. 10, 2007

(54) RECIPROCATING-PISTON MACHINE WITH A JOINT ARRANGEMENT

(75) Inventors: Roland Cäsar, Stuttgart (DE); Peter Kuhn, Weinheim (DE)

(73) Assignees: DaimlerChrysler AG, Stuttgart (DE); Obrist Engineering GmbH, Lustenau (AT)

( * ) Notice: Subject to any disclaimer, the term of this patent is extended or adjusted under 35 U.S.C. 154(b) by 627 days.

(21) Appl. No.: 10/713,779

(22) Filed: Nov. 14, 2003

(65) Prior Publication Data

US 2004/0120831 A1 Jun. 24, 2004

Related U.S. Application Data

(63) Continuation-in-part of application No. PCT/EP02/02828, filed on Mar. 14, 2002.

(30) Foreign Application Priority Data

May 16, 2001 (DE) ..... 101 24 034

(51) Int. Cl.
*F04B 1/12* (2006.01)

(52) U.S. Cl. ..... 417/269

(58) Field of Classification Search ..... 417/222.2, 417/269; 92/71, 13
See application file for complete search history.

(56) References Cited

U.S. PATENT DOCUMENTS 4,662,267 A * 5/1987 Kaku et al. ..... 92/71
4,664,604 A * 5/1987 Terauchi ..... 417/222.2
4,762,468 A 8/1988 Ikeda et al.
5,228,841 A * 7/1993 Kimura et al. ..... 417/222.2
5,477,773 A * 12/1995 Murakami et al. ..... 92/71
6,164,252 A * 12/2000 Kuhn et al. ..... 123/56.3
6,435,074 B1 * 8/2002 Tanaka et al. ..... 92/72

FOREIGN PATENT DOCUMENTS

DE 197 49 727 6/1999
JP 05 306678 11/1993

* cited by examiner

*Primary Examiner*—Michael Koczo
*Assistant Examiner*—Jessica Frantz
(74) *Attorney, Agent, or Firm*—Klaus J. Bach

(57) ABSTRACT

In a reciprocating-piston machine, in particular a refrigerant compressor for a motor vehicle air-conditioning system, including a machine shaft, a plurality of pistons are arranged, at the same distance from the machine shaft, on a cylinder envelope defined by the axes of the pistons and extending around the machine shaft, and an annular pivoting disc which is driven by the machine shaft and which engages the pistons via a joint arrangement, the joint arrangement has an at least partially spherical receptacle, in which at least one sliding element structure is arranged moveably relative to the associated piston and relative to the pivoting disc, including a first sliding element having a first sliding face in the form of a spherical segment with a first geometric center ($M_1$, $M_3$), and a second sliding element having a second sliding face in the form of a spherical segment with a second geometric center ($M_2$, $M_4$) arranged at a distance from the first geometric center.

4 Claims, 4 Drawing Sheets

RECIPROCATING-PISTON MACHINE WITH A JOINT ARRANGEMENT

This is a continuation-in-part application of international application PCT/EP02/02828 filed Mar. 14, 2002 and claiming the priority of German application DE 101 24 034.1 filed May 16, 2001.

BACKGROUND OF THE INVENTION

The invention relates to a reciprocating-piston machine particularly for an air conditioning system of a motor vehicle.

DE 197 49 727 A1 discloses a reciprocating-piston machine of the type which comprises a machine housing, in which a plurality of pistons are arranged in a circular arrangement around a rotating drive shaft. The drive force is transmitted from the drive shaft, via a driver, to an annular pivoting disc and from the latter, in turn, via a joint arrangement, to the pistons, which are supported so as to be movable parallel to the machine shaft. The pivoting disc is mounted pivotably on a sliding sleeve, which is linearly movably supported on the machine shaft. The pivoting disc slides along on the joint arrangement, which extends around the pivoting disc by means of two sliding blocks in the form of a spherical cap. Provided in the joint arrangement is a center of force transmission which is arranged in the extension of the respectively associated piston axis and which forms the geometrical center of the sliding faces of the spherical sliding blocks. The machine shaft, driver, pivoting disc and joint arrangements are arranged in a so-called drive space in which gaseous working medium of the reciprocating-piston machine is present under a specific pressure. The delivery volume and therefore the stroke of the pistons and the inclination of the pivoting disc relative to the machine shaft are dependent on the pressure ratio between the suction side and pressure side of the pistons or are correspondingly dependent on the pressures in the cylinders, on the one hand, and in the drive space, on the other hand.

Patent specification U.S. Pat. No. 4 762 468 discloses a reciprocating-piston machine in the form of a swashplate compressor with a rotating drive shaft, on which a swashplate is fastened in a fixed position. A plurality of pistons is articulated via the swashplate, so that the piston axes of the pistons are arranged at the same distance from the machine shaft, around the latter on a cylinder envelope. For coupling the swashplate and the pistons, for each piston two sliding elements are provided which are mounted in a receptacle in the form of a spherical segment and located on the associated piston and which slide on the swashplate. The sliding elements are designed cylindrically with a semi-spherical end portion. Because of the constant angle between the swashplate and the drive shaft, the positions of the sliding elements do not change when the compressor is in operation, so that a constant play can be set between the sliding elements and the swashplate.

It is the object of the present invention to provide a reciprocating-piston machine with an improved operating behavior and with improved performance.

SUMMARY OF THE INVENTION

In a reciprocating-piston machine, in particular a refrigerant compressor for a motor vehicle air-conditioning system, including a machine shaft, a plurality of pistons are arranged, at the same distance from the machine shaft, on a cylinder envelope defined by the axes of the pistons and extending around the machine shaft, and an annular pivoting disc which is driven by the machine shaft and which engages the pistons via a joint arrangement, the joint arrangement has an at least partially spherical receptacle, in which at least one sliding element structure is arranged moveably relative to the associated piston and relative to the pivoting disc, including a first sliding element having a first sliding face in the form of a spherical segment with a first geometric center ($M_1$, $M_3$), and a second sliding element having a second sliding face in the form of a spherical segment with a second geometric center ($M_2$, $M_4$) arranged at a distance from the first geometric center.

This arrangement is provided with some play when the pivoting disc forms a right angle with the machine shaft and is therefore in a "neutral position", in which no piston stroke is generated. During an adjustment of the pivoting disc into a working position in which it assumes an angle of less than 90° with the machine shaft, the sliding elements are pressed against the pivoting disc by the receptacle. This affords a particularly simple possibility for causing increasing engagement of the joint arrangement with increasing deviation of the pivoting disc from its neutral position.

In a refinement of the invention, the joint arrangement has a center of force transmission which is located approximately on the cylinder envelope of the piston axes and which is positioned in front of the associated piston axis with respect to the direction of rotation of the pivoting disc. The center of force transmission is a geometrical locus at which force transmission between the pivoting disc and the respective piston takes place in an idealized way. Furthermore, the center of force transmission constitutes the center of rotation of the joint arrangement and, if appropriate, the common center of a plurality of sliding or rolling elements. If the center of force transmission is displaced on the cylinder envelope defined by the piston axes, the introduction of forces into the corresponding pistons can be influenced. On the basis of known solutions, in which the center of force transmission is arranged in the extension of the piston axis, the position of the center of force transmission is displaced in front of the piston axis opposite to the direction of rotation of the pivoting disc, so that the torque or tilting moment, exerted on the piston on account of the inclined arrangement of the pivoting disc, and corresponding supporting forces on the piston guide area reduced.

In a further refinement of the invention, the first geometrical center is arranged on a side and the center plane of the pivoting disc, which faces the piston guide, and the second geometrical center is arranged on a side of the center plane of the pivoting disc, which faces away from the piston guide. Preferably, in the neutral position, the arrangement is symmetrical with respect to the center plane of pivoting disc. This results in a uniform reduction in existing play and/or a uniform engagement of the sliding elements when the pivoting disc moves out of the neutral position.

In still a further refinement of the invention, the first geometrical center is arranged on that side of the center plane of the pivoting disc which faces the piston guide and the second geometric center is arranged approximately on the center plane of the pivoting disc or likewise on that side of the center plane of the pivoting disc which faces the piston guide. This results, overall, in a displacement of the center of force transmission in the direction of the piston or respectively, in the direction of the piston guide. As a result, lower moments are introduced to the piston and the supporting forces on the piston guide are lowered.

In still a further refinement of the invention, the first geometric center is arranged on the cylinder envelope offset in the direction of rotation relative to the second geometric center. In this way, play existing in the neutral position is reduced upon pivoting of the pivoting disc in a first direction, and the play is increased upon pivoting of the pivoting disc in the opposite direction.

Further features and feature combinations are apparent from the following description on the basis of the drawings. Actual exemplary embodiments of the invention are illustrated in simplified form in the drawings and are explained in more detail in the following description.

DESCRIPTION OF PREFERRED EMBODIMENTS

Figure 1:
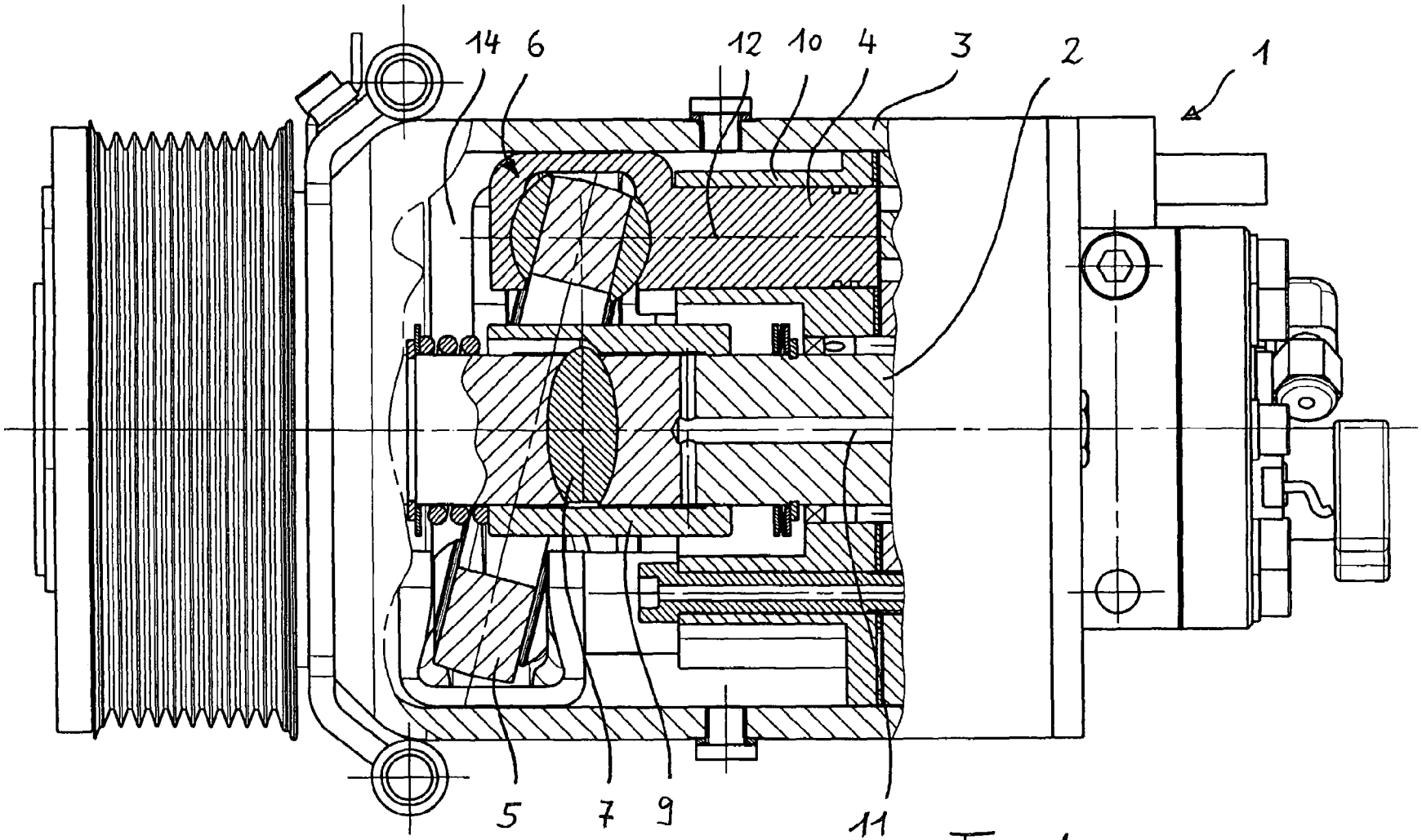
FIG. 1 shows a longitudinal section through a reciprocating-piston machine according to the invention.

FIG. 1 shows in a longitudinal sectional view, a reciprocating-piston machine 1 in the form of a refrigerant compressor for a motor vehicle air-conditioning system. The reciprocating-piston machine 1 has a plurality of pistons 4 arranged in a machine housing 3. All the piston axes 12 are arranged at a fixed distance from the axis of rotation 11, that is to say geometrically on a cylinder envelope (not illustrated), around the machine shaft 2 as defined by the axes of the pistons and are oriented parallel to the axis of rotation 11 of the machine shaft. The pistons 4 are guided in cylindrical bushes 10 (piston guides), in which cylindrical compression chambers 13 are formed (cf. FIGS. 2 to 4). The pistons 4 separate the compression chambers 13 from a so-called drive space 14 ("crankcase"). The rotational movement of the machine shaft is converted into a translational movement of the pistons 4 via a force transmission arrangement explained in more detail below.

A sliding body in the form of a sliding sleeve 9 is slidably supported on the machine shaft 2. A preferably annular pivoting disc 5 is mounted, in turn, on the sliding sleeve 9, the pivoting disc 5 being displaceable jointly with the sliding sleeve 9 in the direction of the axis of rotation 11. Attached to the sliding sleeve 9 on both sides are two short pins 8', which define a hinge axis 8 which is oriented transversely to the axis of rotation 11 of the machine shaft and on which the pivoting disc 5 is pivotably supported on the sliding sleeve 9.

A driver 7 is fixed in a recess 2*a* of the machine shaft 2. The driver 7 projects from the machine shaft 2 approximately at a right angle and extends, with a spherical articulation portion 7*a*, into a radially open receptacle 15 of the pivoting disc 5 (cf. FIG. 2). Since the driver 7 is fixed to the machine shaft 2, pivoting of the pivoting disc 5 about the hinge axis 8 is coupled to the displacement of the sliding sleeve 9, that is, displacement of the hinge axis 8. When the reciprocating-piston machine is in operation, the rotation of the machine shaft 2 is transmitted to the pivoting disc via the driver 7 (rotational movement in the direction of the arrow w).

A main center-plane extending through the axis of rotation 11 and perpendicularly to the hinge axis 8 separates a suction side of the reciprocating-piston machine from a pressure side. The main center-plane rotates with the machine shaft.

Figure 2:
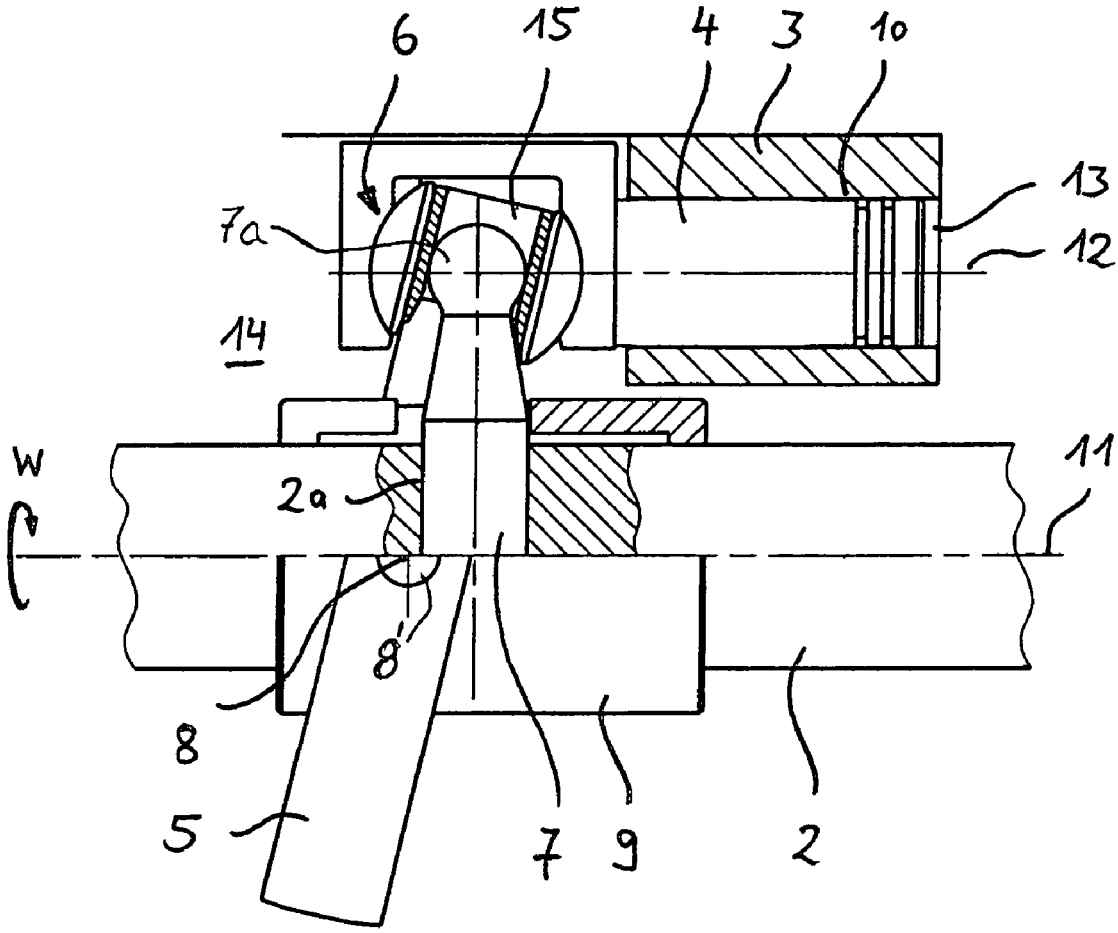
FIG. 2 shows a basic diagram of the functioning of the reciprocating-piston machine according to FIG. 1, FIGS. 3 and 4 show schematically the functioning of a first exemplary embodiment of a joint arrangement according to the invention.

The pivoting disc 5 is provided at its circumference, in the region of each piston 4, by a joint arrangement 6 which slidingly receives the pivoting disc when the latter rotates as indicated by the arrows w. When the pivoting disc 5 is inclined relative to the machine shaft 2, the pivoting disc 5, during its rotational movement, causes the pistons located in the pressure side to execute a compression movement and the pistons located on the suction side to execute a suction movement. FIG. 2 illustrates in a simplified basic arrangement, the force transmission between the machine shaft 2 and pistons 4.

Further particulars as to the construction and functioning of the reciprocating-piston machine 2 may be gathered from U.S. Pat. No. 6,164,252, to which express reference is hereby made. In the design variant of the reciprocating-piston machine known from U.S. Pat. No. 6,164,252, the center of force transmission of a joint arrangement is arranged in each case exactly in the extension of the associated piston axis on the cylinder envelope defined by the axes of the various pistons.

Figure 3:
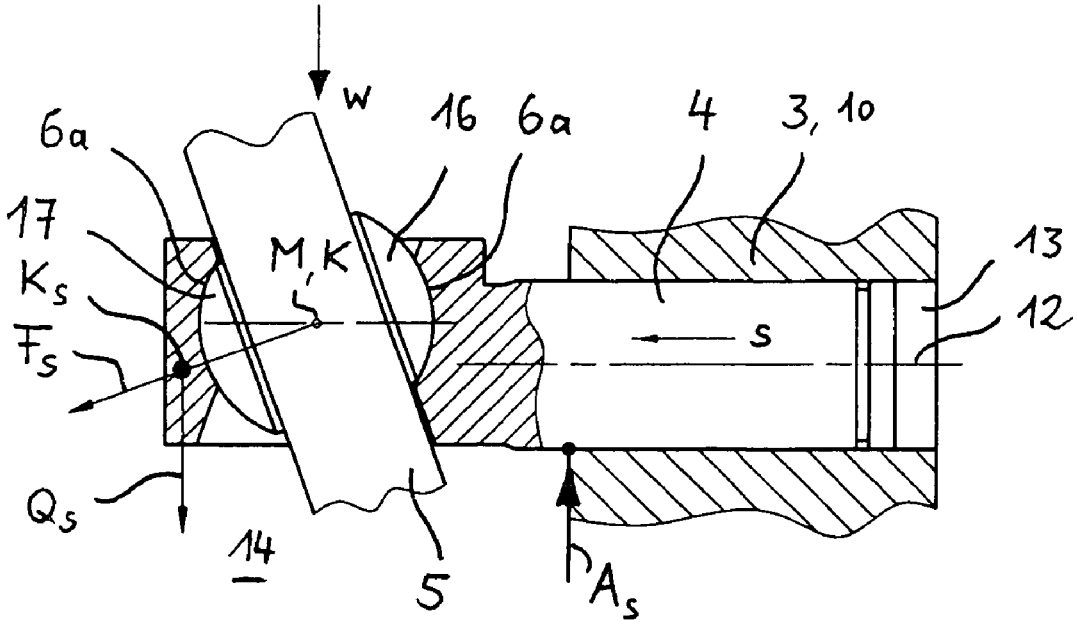
Figure 4:
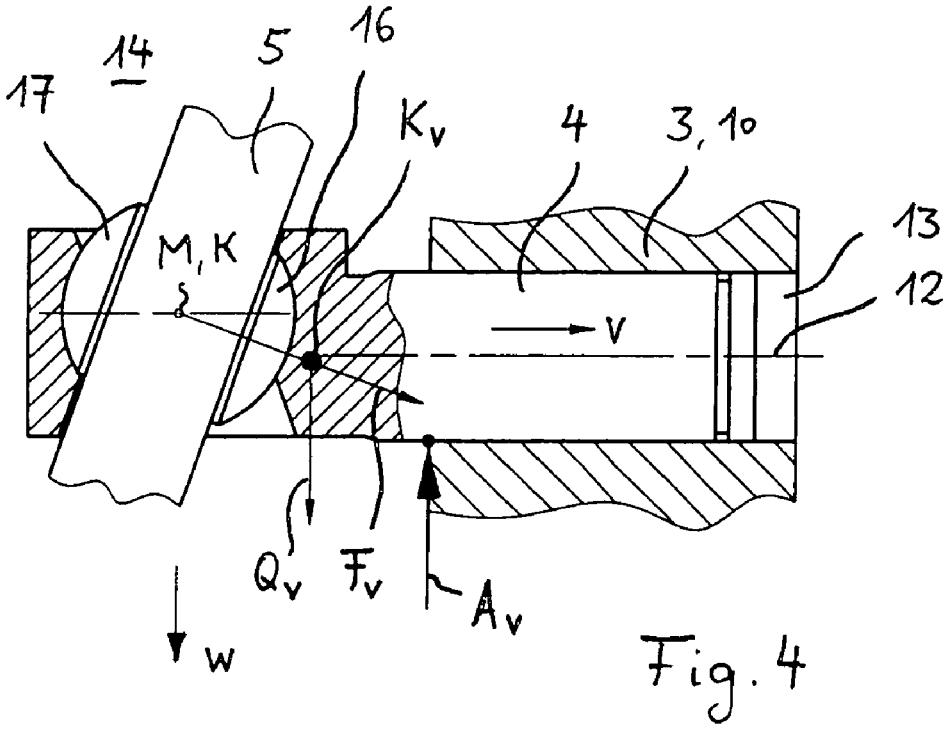

A first exemplary embodiment of the joint arrangement 6 is illustrated diagrammatically in more detail in FIGS. 3 and 4. In this case, FIGS. 3 and 4 (also FIGS. 5 and 6) are views outward from the machine shaft 2 in the radial direction, the pivoting disc 5, which moves in the direction of the arrow w, thereby causing a suction stroke of the piston 4 (arrow s) in FIG. 3 and a compression stroke of the piston 4 (arrow v) in FIG. 4.

The joint arrangement 6 includes a receptacle with two identical approximately spherical guiding and sliding faces 6*a*, in which two sliding elements 16, 17 in the form of spherical caps are mounted. The receptacle and the sliding elements 16, 17 have a common geometric center M which at the same time forms a center of force transmission K of the joint arrangement 6. The sliding faces 6*a* of the receptacle and the spherical faces of the sliding elements 16, 17 have the same radius and the same curvature. The sliding elements 16, 17 are seated with slight play on the pivoting disc 5. The center of force transmission K is positioned in front of the piston axis 12 of the associated piston 4, opposite to the direction of rotation (arrow w), on the cylinder envelope containing all the piston axes. The distance of the center of force transmission from the piston axis 12 is preferably 10% to 20% of the piston stroke.

During the suction stroke (according to FIG. 3), the force $F_s$ transmitted to the piston 4 by the pivoting disc 5 is generally markedly lower than the force $F_v$ transmitted during the compression stroke (according to FIG. 4). This results accordingly in sharply varying transverse forces $Q_s$ and $Q_v$. These transverse forces $Q_s$ and $Q_v$ generate in each case on the piston moments which have to be accommodated by the piston guide 10 and ultimately result in supporting forces $A_s$ and $A_v$. The supporting forces $A_s$ and $A_v$ are illustrated, idealized, in the region of the lower end of the piston guide 10. The lateral offset of the center of force transmission results in idealized force introduction points $K_s$ and $K_v$ on the piston axis 12. The force introduction point $K_s$ for the suction stroke is thus further away from the piston 4 and from the piston guide 10 than the center of force transmission K of the joint arrangement, whilst the force introduction point $K_v$ for the compression stroke is nearer to the piston 4 than the center of force transmission K of the joint arrangement. For the suction stroke (according to FIG. 3), this means that the transverse force $Q_s$ is introduced further away from the piston guide 10, whilst, during the compression stroke (according to FIG. 4), the transverse force $Q_v$ is introduced nearer to the piston guide 10, without an offset between the center of force transmission K and the piston axis 12. This results for the suction stroke in a comparatively increased moment on the piston in relation to an arrangement without an offset, and, for the compression stroke, in a comparatively reduced moment. The same occurs accordingly with the supporting forces $A_s$ and $A_v$ which, in a preferred embodiment, are approximately identical.

Figure 5:
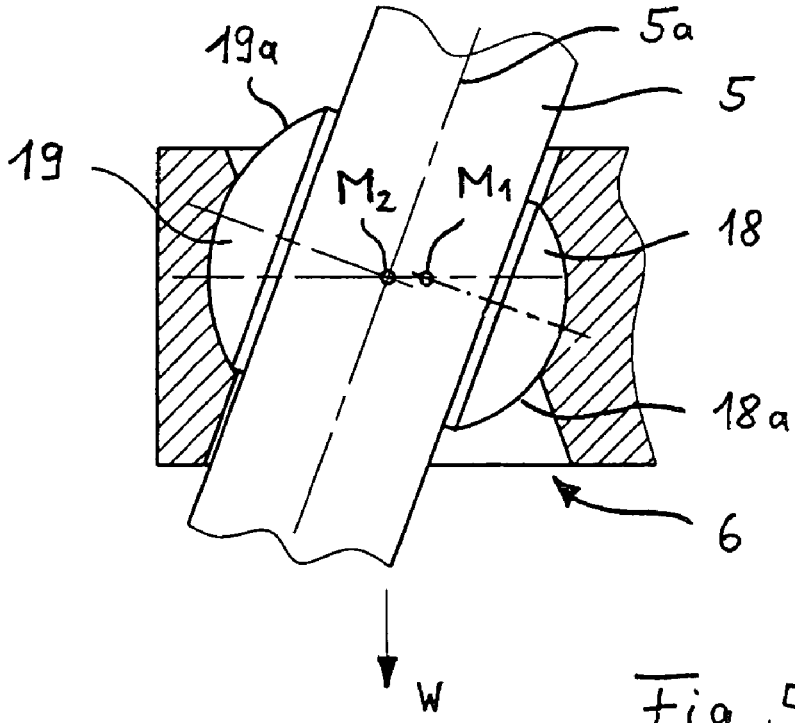
FIG. 5 shows a schematically the functioning of a second exemplary embodiment of the joint arrangement.

A second exemplary embodiment of the joint arrangement 6 according to the invention is illustrated in FIG. 5. The joint arrangement 6 has a receptacle with two spherical sliding/guiding faces 6*a*, 6*b*, in which a first sliding element 18 with a sliding face 18*a* in the form of a spherical segment and a second sliding element 19 with a sliding face 19*a* in the form of a spherical segment are mounted. The first sliding element 18 is arranged on the side facing the associated piston and the second sliding element 19 is arranged on that side of the pivoting disc 5, which faces away from the piston, the sliding elements 18, 19 being disposed at opposite sides of the pivoting disc 5.

The geometric center $M_1$ of the first sliding element 18 is arranged between the center-plane 5*a* of the pivoting disc 5 and the piston (not illustrated), while the geometric center $M_2$ of the second sliding element 19 is located on the center-plane 5*a*. Different radii of curvature of the sliding faces 18*a* and 19*a* are thus obtained for an identical angular moveability, the smaller radius being provided on the sliding element 18 arranged on the same side as the piston guide. In the "neutral position" of the pivoting disc 5, that is to say when the pivoting disc and the machine shaft form an angle of 90°, the sliding elements 18, 19 are seated with some play on the pivoting disc 5, so that, upon start up of the reciprocating-piston machine, low frictional forces occur between the sliding elements and the pivoting disc and a lubricating film can form quickly. In the event of an inclination of the pivoting disc 5 (increasing pivoting angle), the play is reduced for reasons of geometry, so that finally, in the case of an inclination of the pivoting disc, as shown in FIG. 5, in the load-free state, the joint arrangement is tightly engaged (pre-stress). This pre-stress is accommodated in that the joint arrangement 6 is bent open due to forces arising when the reciprocating-piston machine is in operation. Ideally, in the load-state, the static pre-stress and the dynamic operating forces at the joint arrangement neutralize each other.

Since, with an increasing pivoting angle of the pivoting disc 5, the load to be absorbed by the joint arrangement 6 rises in both directions of the piston movement, an increasing elastic bending-open of the joint arrangement 6 is caused with a corresponding amount of noise being generated. By means of the proposed arrangement, this can be greatly reduced or eliminated during the suction movement and during the compression movement.

The center of force transmission of the joint arrangement 6 is located between the two geometrical centers $M_1$, $M_2$ in the pre-stressed state, so that the introduction of force into the piston takes place, in general, nearer to the piston guide and a lower tilting moment is exerted on the piston (as compared with arrangements with a center of force transmission on the center-plane 5*a*). Exemplary embodiments may nevertheless be provided, in which the geometrical centers $M_1$, $M_2$ are arranged approximately mirror-symmetrically with respect to the center-plane 5*a* and the center of force transmission is arranged on the center-plane 5*a*.

Figure 6:
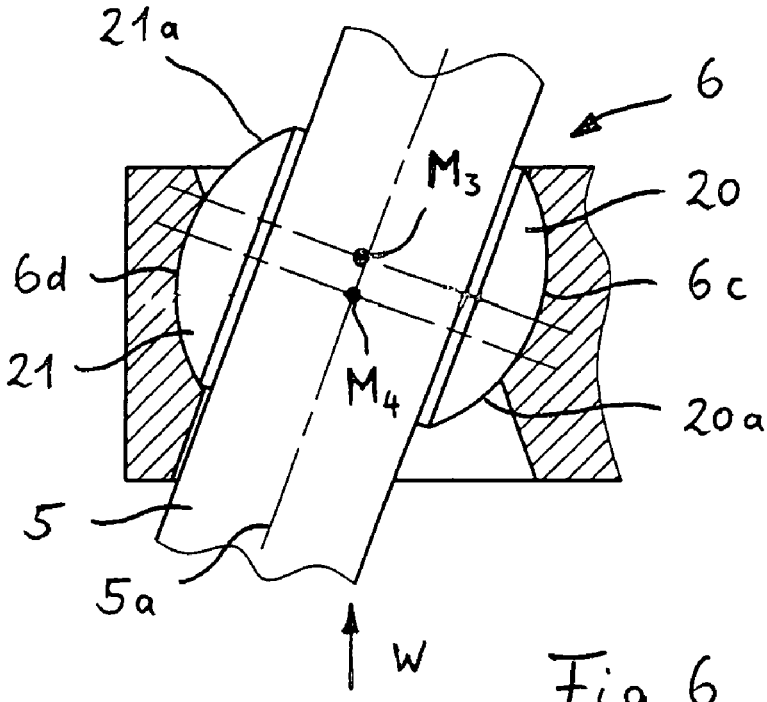
FIG. 6 shows schematically the functioning of a third exemplary embodiment of the joint arrangement.

A third exemplary embodiment of the joint arrangement 6 according to the invention is illustrated in FIG. 6. The joint arrangement 6 comprises two sliding elements 20, 21 corresponding to those in the exemplary embodiments described above. The sliding elements 20, 21 have in each case sliding faces 20*a*, 21*a* which are in the form of a spherical segment and which slide in a receptacle 6*c*, 6*d*. The sliding faces 20*a*, 21*a* possess geometric centers $M_3$, $M_4$ which are located, on the one hand, approximately on the center-plane 5*a* of the pivoting disc 5 and, on the other hand, on the cylinder envelope on which all the piston axes 12 (cf. FIGS. 1 to 3) of the reciprocating-piston machine are also positioned. The geometric center $M_3$ of the sliding element 20 located nearer to the piston guide is arranged behind the center $M_4$ of the opposite sliding element 21, as seen in the direction of rotation of the pivoting disc (arrow w). As a result, in the case of an inclination of the pivoting disc 5, as illustrated in FIG. 6, there is, for geometric reasons, a reduction in the play provided in the "neutral position" of the pivoting disc. Bracing of the sliding elements 20, 21 therefore takes place during the suction stroke according to FIG. 6. In the event of an inclination of the pivoting disc 5 in the opposite direction (compression stroke, not illustrated), there is an increase in the play provided in the "neutral position".

In a modified exemplary embodiment, a piston joint arrangement is provided, which has sliding blocks with sliding faces which are in the form of a spherical segment and the centers of which, according to a combination of features present in the above-mentioned exemplary embodiments, are positioned in front of the associated piston axis, are at a distance from one another in a direction parallel to the piston axis and/or are offset to one another in the direction of rotation of the pivoting disc.

By means of the proposed joint arrangements, reciprocating-piston machines can be designed, which, with essentially the same dimensioning, can withstand higher dynamic loads in the region of force transmission between the pivoting disc and pistons, as compared with reciprocating-piston machines according to the prior art. At the same time, reduced or equalized force conditions are obtained in the region of the piston guides and at the joint arrangements. This results in higher performances, and at the same time quieter operation and lower operating noises.

What is claimed is:

1. A reciprocating-piston machine, in particular a refrigerant compressor (1) for a motor vehicle air-conditioning system, comprising:

a rotatable machine shaft (2), a plurality of pistons (4) movably supported by piston guides (10) and having piston axes which extend parallel to, and are arranged all at the same distance from, the machine shaft (2) and in circumferentially spaced relationship, on a cylinder envelope around the machine shaft, an annular pivoting disc (5) extending around the machine shaft (2) and being connected to said machine shaft (2) so as to be driven thereby, each of said pistons (4) being engaged with said pivoting disc (2) by a joint arrangement (6), said joint arrangement (6) including an at least partially spherical receptacle with at least one bearing element (18, 19) arranged in said receptacle moveably relative to an associated piston and relative to said pivoting disc, a first sliding element (18, 20) having a first sliding face (18*a*, 20*a*) in the form of a spherical segment, with a first geometric center of curvature ($M_1$, $M_3$), and a second sliding element (19,21) having a second sliding face (19*a*, 21*a*) in the form of a spherical segment, with a second geometric center of curvature ($M_2$, $M_4$), said first and said second geometric centers of curvature being arranged at a distance from one another, said joint arrangement (6) having a center of force transmission (K) which is located approximately on said cylinder envelope defined by said piston axes and positioned in front of the associated piston axis (12) with respect to the direction of rotation of the pivoting disc (5).

2. A reciprocating-piston machine according to claim 1, wherein the first geometric center of curvature (M1) is arranged on a side of the center plane (5*a*) of said pivoting disc (5), which faces the piston guide and the second geometric center of curvature (M2) is arranged on a side of the center-plane of said pivoting disc, which faces away from the piston guide.

3. A reciprocating-piston machine according to claim 1, wherein the first geometric center of curvature ($M_1$) is arranged on that side of the center plane (5*a*) of the of the pivoting disc (3), which faces the piston guide and the second geometric center of curvature ($M_2$) is arranged approximately on the center plane (5*a*) of the pivoting disc or on that side of the center plane (5*a*) of the pivoting disc, which faces the piston guide.

4. A reciprocating-piston machine according claim 1, wherein the first geometric center of curvature ($M_3$) is arranged on said cylinder envelope so as to be offset in the direction of rotation (w) relative to the second geometric center of curvature ($M_4$).

* * * * *